United States Patent [19]

Mitchell

[11] Patent Number: 4,796,306

[45] Date of Patent: Jan. 10, 1989

[54] READILY ADJUSTABLE GRIP ENHANCING GRIPPING GLOVE

[76] Inventor: Rodger Mitchell, 921 Pontiac, Wilmette, Ill. 60091

[21] Appl. No.: 173,044

[22] Filed: Mar. 23, 1988

Related U.S. Application Data

[63] Continuation-in-part of Ser. No. 22,989, Mar. 6, 1987, abandoned.

[51] Int. Cl.[4] ..... A41D 19/00

[52] U.S. Cl. ..... 2/160; 2/161 A; 2/163

[58] Field of Search ..... 2/161 A, 161 R, 160, 2/163

[56] References Cited

U.S. PATENT DOCUMENTS

| | | | |
|---|---|---|---|
| Re. 31,538 | 3/1984 | Antonious | 2/161 A |
| 2,751,598 | 6/1956 | Romeo | 2/161 A |
| 2,852,779 | 9/1958 | Roessler | 2/161 A |
| 3,100,302 | 8/1963 | Billings | 2/160 |
| 3,105,972 | 10/1963 | Christopher | 2/161 A |
| 3,348,238 | 10/1967 | Hydock | 2/161 A |
| 3,532,344 | 10/1970 | Masstab | 2/161 A |
| 3,559,212 | 2/1971 | Skovron | 2/161 A |
| 4,368,883 | 1/1983 | Tiktin | 2/163 |
| 4,675,914 | 6/1987 | Mitchell | 2/161 A |

*Primary Examiner*—Louis K. Rimrodt
*Attorney, Agent, or Firm*—Wall and Roehrig

[57] ABSTRACT

A gripping glove having a plurality of elastic straps which are readily positionable to impose a selected gripping force to the fingers of a user to improve the user's grip. The gripping glove utilizes elastic straps selectively positionable by use of a releasable fastening surface, such as Velcro, to enable the tension force imposed by the straps to be readily changed including when the glove is in use.

6 Claims, 3 Drawing Sheets

FIG. 2
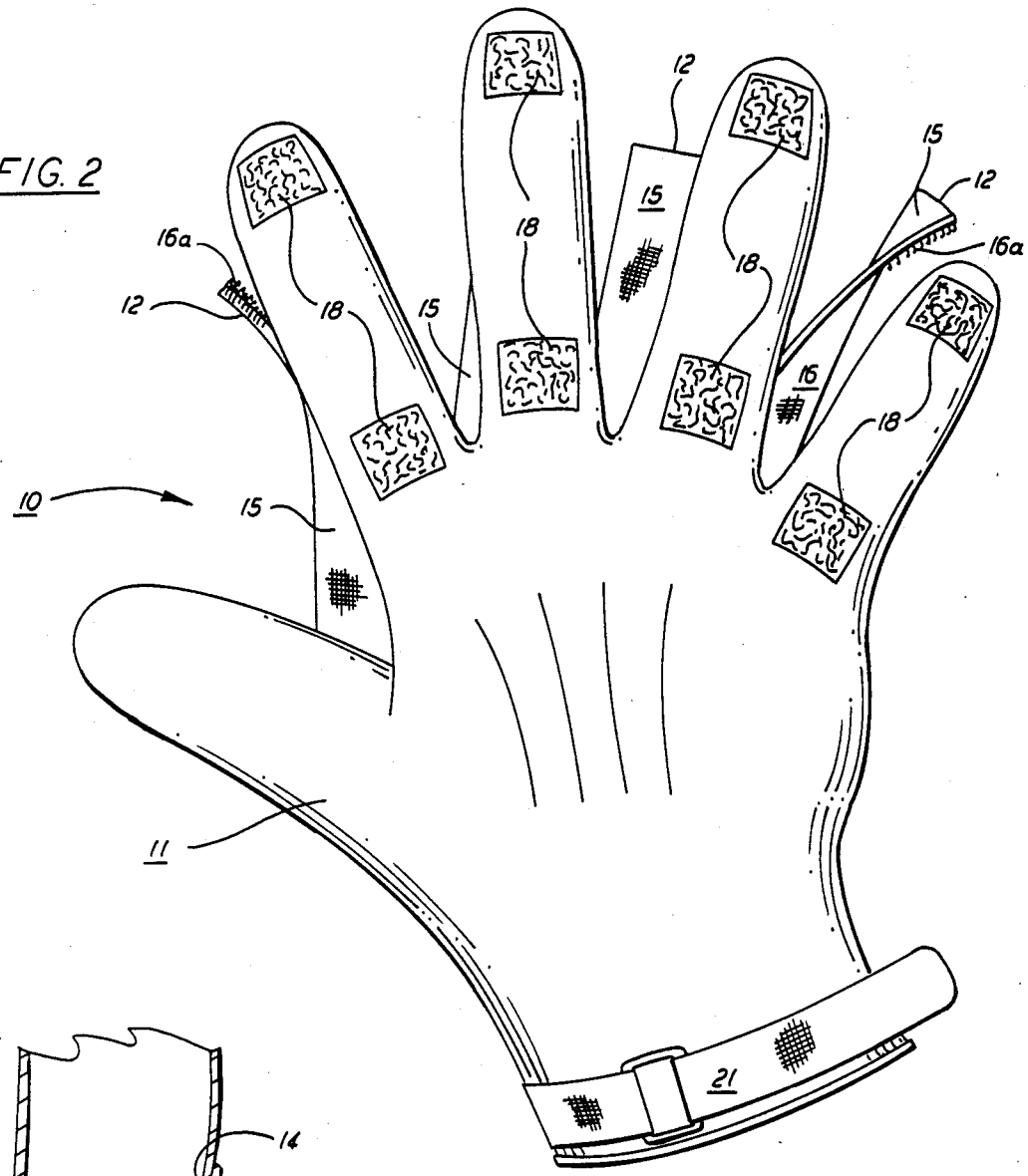
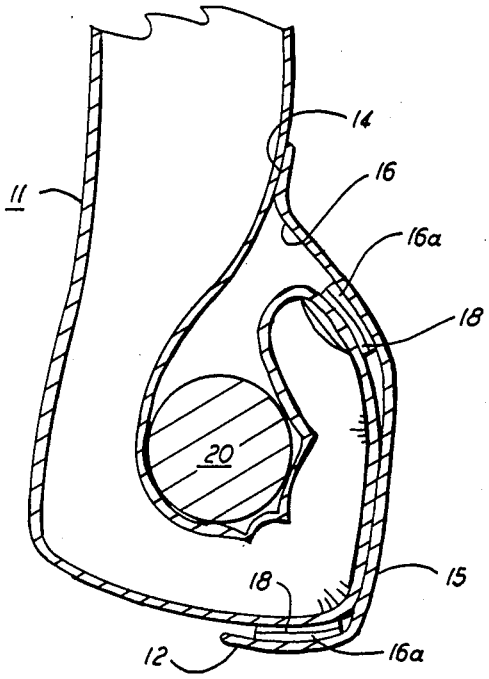
FIG. 4

READILY ADJUSTABLE GRIP ENHANCING GRIPPING GLOVE

This is a continuation-in-part of co-pending application Ser. No. 022,989, filed on Mar. 6, 1987, now abandoned.

BACKGROUND OF THE INVENTION

This invention relates in general to a glove for improved gripping and, in particular, to a glove incorporating an elastic strap for providing an increased, yet readily adjustable, gripping force to the user's grip.

More specifically, but without restriction to the particular embodiment and/or use which is shown and described for purposes of illustration, this invention relates to a gripping glove incorporating an elastic strap through which various tension forces can be applied for imposing an auxiliary gripping force on the individual fingers of the user, which force is adjustable while wearing the glove.

In recreational or sports activities such as tennis, golf, baseball or racketball, for example, one of the important factors in determining player proficiency is the manner in which a racket, club or bat is gripped by the user. If an insufficient amount of gripping force is used, the racket or club will twist in the hand upon impact with a ball, causing the ball to be misdirected. Many sports enthusiasts, in an attempt to prevent this from happening, concentrate so much on gripping the racket, club or bat tightly that an incorrect swing occurs.

Since many such sports permit a player to utilize a glove to improve gripping, incorporating a grip-enhancing force applying system into the glove would increase the user's gripping force. Such a glove would be an improvement over those presently available, which only enhance the frictional relationship between the material of the glove and the object to be gripped. The glove would provide an increased gripping force so that a user would be able to grip with a sufficient gripping force to prevent the racket or club from twisting, while permitting the user to concentrate more on a proper swing in order to improve game proficiency.

Since it would be desirable to vary the amount of force to accommodate individual players, a further feature of such a gripping glove is to permit variation of the magnitude of the auxiliary gripping force applied to adjoining fingers, and to even permit changes in the force applied to an individual finger as the player's abilities or physical conditioning changes. One example of such a gripping glove is disclosed in the inventor's co-pending application "HARD-GRIP GLOVE", filed May 12, 1986 under Ser. No. 862,262 and now U.S. Pat. No. 4,675,914, 6/30/87. The gripping glove of that invention utilizes a number of coiling springs which are interchangeable to vary an auxiliary gripping force. The present invention utilizes elastic straps so that the auxiliary gripping force can be selectively varied by the user more easily, even while using the gripping glove.

SUMMARY OF THE INVENTION

It is, therefore, an object of this invention to provide a sports glove incorporating a readily adjustable gripping force applying system.

Another object of this invention is to conveniently vary the individual force applied to fingers inserted into the gripping glove, even while the glove is in use.

A further object of this invention is to provide a readily variable system of force application so that the gripping force applied to individual fingers of the gripping glove can be conveniently varied with the preference of the user.

These and other objects are attained in accordance with the present invention wherein there is provided a gripping glove having a plurality of elastic straps which are positionable to impose a selective gripping force to the fingers of a user to improve the user's grip. The gripping glove utilizes elastic straps which have one end sewn into the glove with the free end being positionable over the user's fingers to provide an improved gripping force. The glove and the elastic straps have a releasably adhering material secured thereto so that the tension in the strap may be conveniently changed to vary the grip enhancing force applied to each finger.

DESCRIPTION OF THE DRAWINGS

Further objects of the invention together with additional features contributing thereto and advantages accruing therefrom will be apparent from the following description of preferred embodiments of the invention which are shown in the accompanying drawings with like reference numerals indicating corresponding parts throughout, wherein:

FIG. 2 is a planar view of the back of the gripping glove shown in FIG. 1 to illustrate the releasably adhering material secured to the back of the finger portion which in cooperation with the elastic strap creates a grip-enhancing force;

FIG. 4 is a partial side elevation of the glove illustrated in FIG. 3 with portions removed to better illustrate the manner in which the gripping force is applied;

DESCRIPTION OF PREFERRED EMBODIMENT

Figures 1, 3:
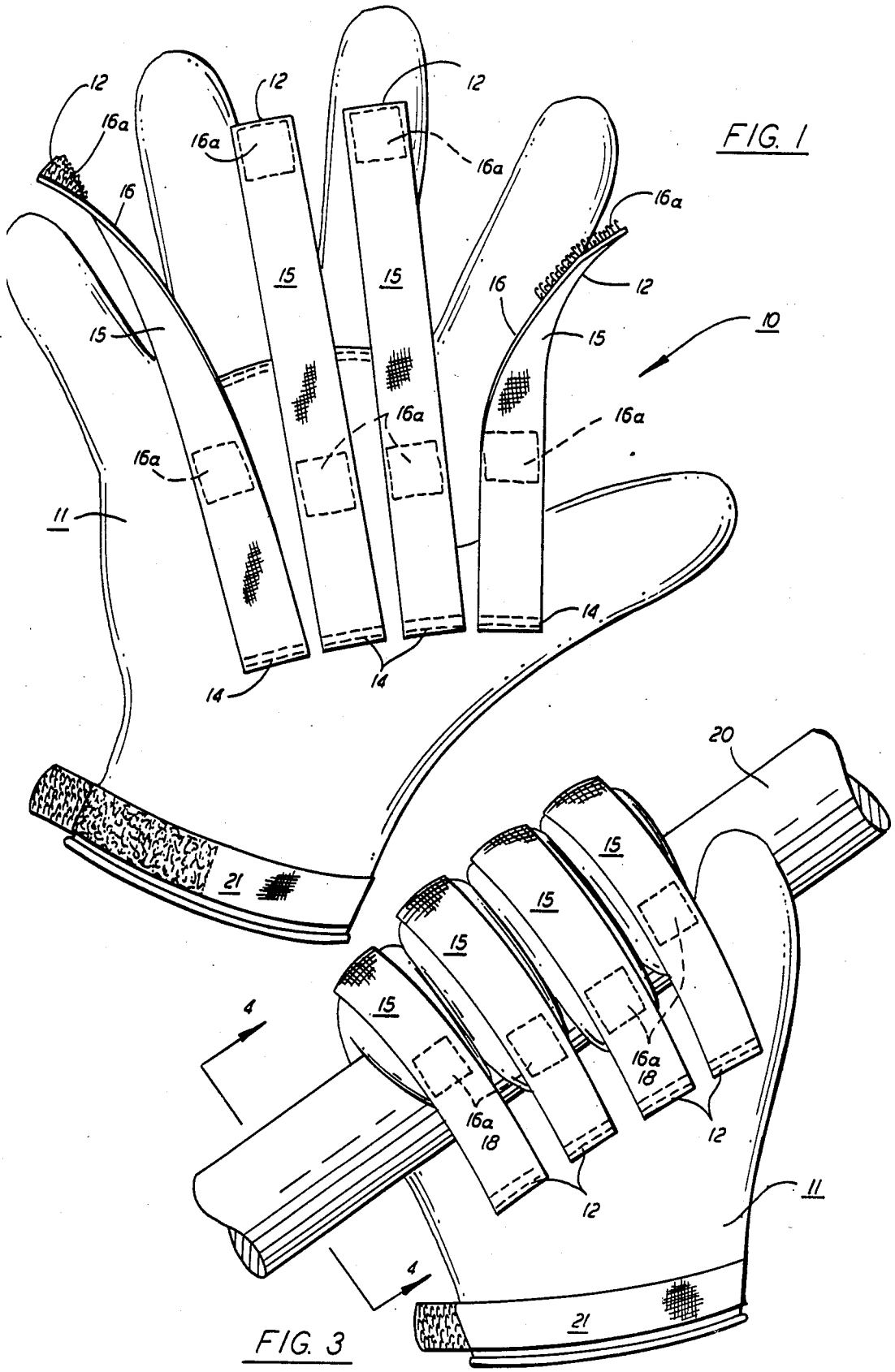
FIG. 1 is a planar view of the palm of a gripping glove illustrating grip-enhancing elastic straps attached to the palm portion of the glove to improve the user's grip.
FIG. 3 is a view of the gripping glove in use to illustrate the manner in which a grip-enhancing force is applied when using the glove.

Referring now to FIG. 1, there is shown a palm side view of a glove 10 used for engaging in sports such as tennis, golf or baseball and constructed by sewing together two or more pieces of material 11 cut into a hand-shaped configuration. The glove 10 is formed with portions for receiving the fingers and thumb of the user, and may include ventilation holes and/or a friction enhancing gripping surface on its palm, neither of which are shown in the drawings. One or more grip-enhancing elastic straps 15 are secured, as by sewing 14, one end to the palm side of the glove 10, with the opposite end 12 of the strap being unattached. The entire surface of the side 16 of the strap facing the palm portion of the glove can be covered with a portion of a Velcro releasable fastening system, such as the material disclosed in U.S. Pat. No. 3,114,951 or pads 16*a* of such material can be secured to the strap surface, as illustrated in the drawings.

As best illustrated in FIG. 2, the back portion of the glove has a first plurality of pads 18 secured thereto and positioned at the tip of the finger portion adjacent to where a user's fingernails would be located when the glove is in use. A second plurality of pads 18 is secured to the back portion of the glove at a position corresponding to or adjacent the knuckle joint formed between the hand and the base of the fingers, when the glove is in use. These pads 18 are formed of a complementary portion of the Velcro releasable fastening system described above.

In use, a user inserts a hand in the glove 10 and grips an object 20 such as a tennis racket. The unattached or "free" end 12 of each of the straps 15 is individually pulled outwardly from its fixed end 14 on the palm side of the glove over the outer or back side of the glove fingers, as best illustrated in FIG. 4. The strap 15 is pulled to a desired tension, and the complementary surfaces 16,18 of the releasable fastening system are engaged retaining the elastic strap 15 in a taut condition about the finger. In this manner an auxiliary gripping force is applied against the back of the fingers helping the hand grip the racket. If the user desires to change the auxiliary force applied, as for a more comfortable grip, the free end of the strap 15 is pulled to release the engagement of surfaces 16, 18 to loosen or tighten the strap. To assist in retaining the glove on the hand of a user, a conventional cinching strap 21 is used.

Figure 5:
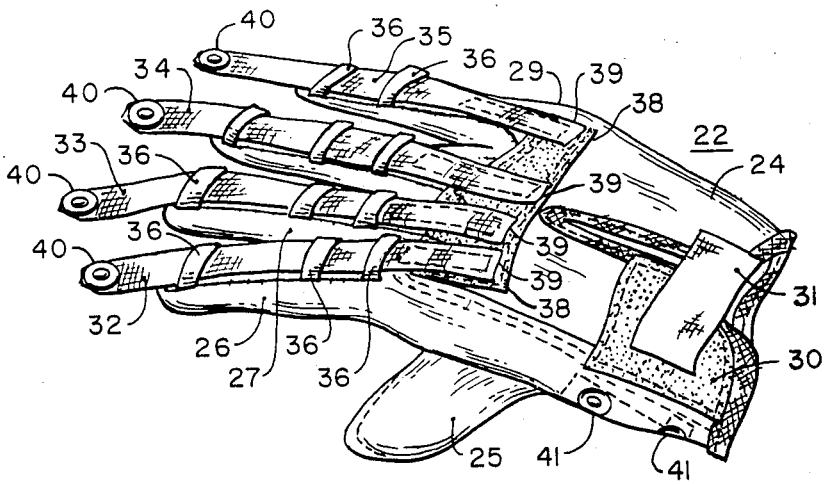
FIG. 5 is a respective view of the back of a gripping glove according to another embodiment of this invention.
Figure 6:
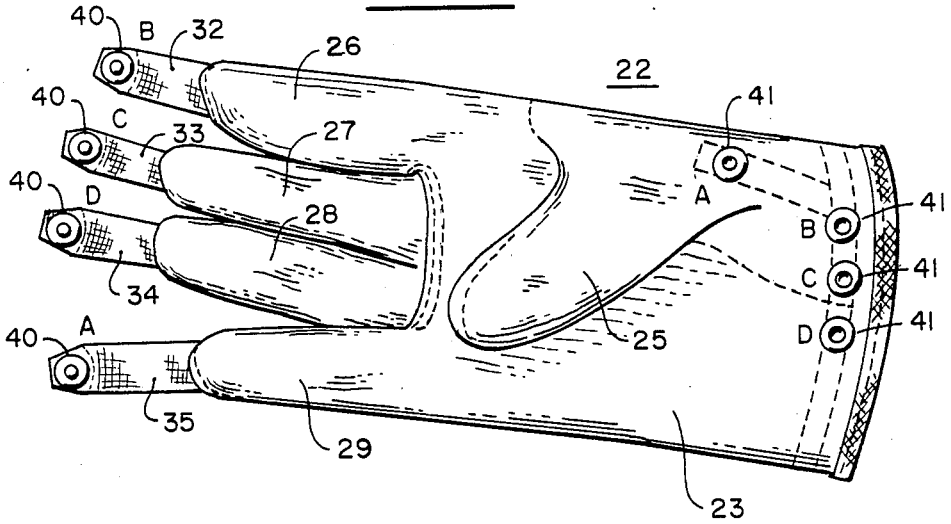
FIG. 6 is a planar view of the palm side of the gripping glove of FIG. 5.
Figure 7:
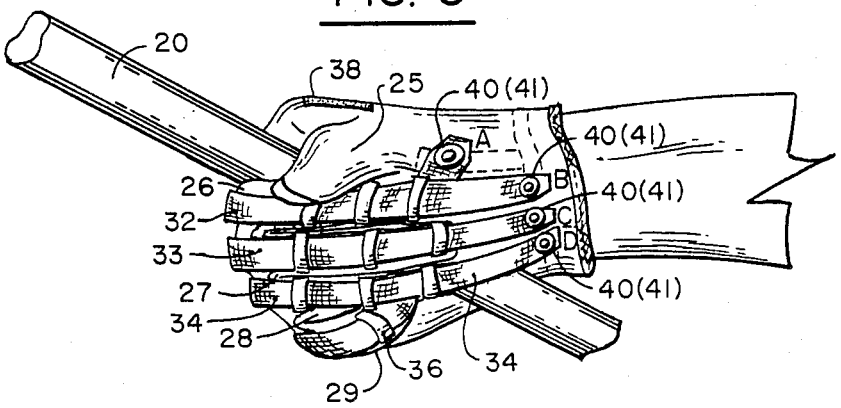
FIG. 7 is a view of the gripping glove of FIGS. 5 and 6 showing the manner in which a grip-enhancing force is applied when using the glove.

According to another embodiment, as shown in FIGS. 5, 6, and 7, a gripping glove 22 has a palm portion 23, a back portion 24, a thumb 25, and first through fourth fingers 26, 27, 28 and 29. A Velcro pad 30 is affixed on the back and a mating Velcro cinching strap 31 is disposed opposite it, in known fashion.

In this glove 22, there are first through fourth elastic straps 32, 33, 34, and 35, each associated with a respective one of the glove fingers 26, 27, 28, 29. Cross-straps or loops 36 are provided on the backs of the fingers 26–29, and the associated straps 32–35 are positioned behind the fingers by passing through these loops 36. There are three loops on each of the first through third fingers 26, 27, 28 and two loops on the fourth finger 29. There is a loop at each finger tip and each knuckle joint for the fingers 26–28.

A Velcro pad 38 is situated across the back 24 of the glove, and a back end of each of the elastic straps 32–35 is provided with a mating strip of Velcro 39. This permits independent adjustment of each of the straps 32–35. On the front end of each of the associated straps there is a male snap fastener 40 with four female snap fastener portions 41 being situated at predetermined positions on the palm 23 of the glove.

The straps and fasteners in FIG. 6 have been identified with letters A, B, C, and D to show the manner of fastening. For the first through third fingers 26, 27, 28, the associated female strap fasteners 39 are generally in line with the fingers. However, for the fourth finger 29, i.e., the little or pinkie finger, the associated female fastener 41 is situated across the palm, i.e., at the base of the thumb 25.

The manner of gripping a racket or other object 20 is illustrated in FIG. 7. The straps not only hold the wearer's fingers in place, but because the straps 32–35 pass behind the fingers from the back to the palm, their grip-enhancing force is distributed over the fingers. This pulls the wearer's fingers, and not just the glove, into a secure grip.

While the invention has been described in the specification and illustrated in the drawings with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiments illustrated by the drawings and described in the specification as the best mode presently contemplated for carrying out this invention, but that the invention will include any embodiments falling within the description of the appended claims.

I claim:

1. A gripping glove comprising:

a palm;

first through fourth fingers;

a thumb; and a back portion for receiving the hand of a user; and first through fourth resilient grip-enhancing fource-applying means, each of said means including an elastic strap, means on the back of the associated finger for positioning said strap along the back of the finger, means securing a front end of each said strap to a predetermined position on said palm, and means for adjustably positioning a back end of each of said straps to said back portion such that the grip-enhancing force applied by the associated straps running behind the associated fingers of the user's hand within the glove for optimally distributing said grip enhancing force.

2. The gripping glove of claim 1 wherein said means for securing the front end of said elastic straps includes respective snap fasteners disposed at the front end of the straps and cooperating snap members disposed at said predetermined positions on said palm.

3. The gripping glove of claim 1 wherein said adjustably positioning means includes first through fourth portions of a releasably engaging pile type material affixed onto the back ends of the associated straps, and said back portion includes a portion of a mating releasably engaging pile type material carried thereon.

4. The gripping glove of claim 1 wherein said means on the back of said first through fourth fingers for positioning said straps each include at least one loop attached to the back of the respective finger through which the strap passes.

5. The gripping glove of claim 4 wherein each said finger has two of said loops through which the associated strap passes.

6. The gripping glove of claim 1 wherein said predetermined positions on said palm are in line with said fingers for said first through third fingers, and across the palm for said fourth finger.

* * * * *